US007947218B2

(12) United States Patent
Simpson et al.

(10) Patent No.: US 7,947,218 B2
(45) Date of Patent: May 24, 2011

(54) APPARATUS AND METHOD FOR COIL COOLING

(75) Inventors: Stephen D. Simpson, Bath (CA); Jean-Francois Ruta, Kingston (CA)

(73) Assignee: Novelis Inc., Toronto, Ontario (CA)

( * ) Notice: Subject to any disclaimer, the term of this patent is extended or adjusted under 35 U.S.C. 154(b) by 695 days.

(21) Appl. No.: 11/807,456

(22) Filed: May 29, 2007

(65) Prior Publication Data

US 2008/0029191 A1 Feb. 7, 2008

Related U.S. Application Data

(60) Provisional application No. 60/811,925, filed on Jun. 8, 2006.

(51) Int. Cl.
*C21D 1/62* (2006.01)

(52) U.S. Cl. ..... 266/259; 266/251; 148/601; 148/627

(58) Field of Classification Search ..... 266/259; 148/601
See application file for complete search history.

(56) References Cited

U.S. PATENT DOCUMENTS

| | | | | |
|---|---|---|---|---|
| 3,580,331 | A | 5/1971 | Wargo | |
| 4,310,302 | A | 1/1982 | Thekdi et al. | |
| 4,423,857 | A | 1/1984 | Muzak et al. | |
| 4,516,758 | A | 5/1985 | Coble | |
| 6,040,658 | A * | 3/2000 | Bashlov et al. | 313/637 |
| 2002/0141195 | A1 * | 10/2002 | Peter | 362/362 |
| 2003/0007867 | A1 | 1/2003 | Chang | |
| 2006/0139881 | A1 | 6/2006 | Jan et al. | |

* cited by examiner

*Primary Examiner* — Roy King
*Assistant Examiner* — Christopher Kessler
(74) *Attorney, Agent, or Firm* — Hudak, Shunk & Farine Co. LPA

(57) ABSTRACT

A cooling device including an air source, preferably a fan, that provides air flow and a shroud for directing air flow from the air source at an object, particularly a coil of material, preferably a metal or metal alloy having a temperature greater than the ambient room temperature. The cooling device provides cooling efficiency by directing the air from the air source at an increased velocity to a desirable area or areas on an end surface of the object, thereby increasing heat transfer from the object. The cooling device shroud includes an air directing surface that influences the direction of air flow across the object in a desired pattern. Methods for preparing cooling devices and for cooling objects are also described.

34 Claims, 3 Drawing Sheets

APPARATUS AND METHOD FOR COIL COOLING

CROSS REFERENCE

This is a U.S. patent application of U.S. provisional application 60/811,925, filed Jun. 8, 2006 for a Apparatus and Method for Coil Cooling, which is hereby fully incorporated by reference.

FIELD OF THE INVENTION

The present invention relates to a portable cooling device including an air source, such as a fan, that provides air flow, and a shroud for directing air flow from the air source at an article, particularly (a) a coil of material or (b) a non-coil metal article such a sheet, plate or ingot, having a temperature greater than the ambient room temperature. The cooling device provides cooling efficiency by directing the air from the air source at an increased velocity to a desirable area or areas on a surface of the object, thereby increasing heat transfer from the object. The cooling device shroud includes an air directing surface that influences the direction of air flow across the object in a desired pattern. Methods for preparing cooling devices and for cooling objects, particularly coils, are also described.

BACKGROUND OF THE INVENTION

In the metallurgical or metalworking field, sheets or pieces of a metal or metal alloy are processed in any number of ways that can raise the temperature of the sheet above the temperature of the ambient room temperature. The processed sheets are subsequently rolled into a coil. For example, sheets that have been treated using a cold rolling process can reach temperatures above 200° C. during the process. Heat treatments utilized to treat sheets include, but are not limited to, continuous annealing/solution heat treatment (SHT) and batch annealing. During a continuous annealing/SHT process, the sheet is uncoiled and then first passed through a furnace section and then a quench section. For some metals or alloys, the sheet comes off the quench at higher than room temperature. During batch annealing, the entire coil is placed in a furnace where it is heated to a predetermined temperature and held for a predetermined period of time, such as several hours, after which the coil is removed and allowed to cool.

Following a procedure such as, but not limited to, one of the above described procedures, it is often necessary to cool the sheet coils to ambient room temperature either as a final step prior to storing/shipping or the like, or in preparation for a subsequent step in a manufacturing sequence.

One current practice in the art is to provide forced air cooling by positioning an axial flow fan adjacent a coil and directing air flow at the coil. The air flow is generally perpendicular to the horizontal axis of the coil at the surface of the coil end, and the velocity of air is limited by the air exit velocity of the fan. When the coil has a hollow core or center, some of the air passes through the coil center and therefore does not contribute significantly to coil cooling. Furthermore, some of the air passes along the outside of the coil diameter and also does not provide efficient heat transfer.

SUMMARY OF THE INVENTION

The cooling device of the present invention comprises an air source and a shroud connected to the air source. The shroud includes an air directing surface having one or more apertures in an arrangement adapted to direct air from the air source at a predetermined area or areas on a surface of an article, such as a coil or a non-coil article, preferably of a metal or metal alloy. The shroud is utilized to direct air flow across a surface of the article to achieve more efficient cooling when compared to using the air source alone. In one embodiment, the shroud design increases the air velocity to a value greater than the velocity exit value from the air source such as a fan. In a further embodiment, the shroud includes an adaptor that allows the device to be utilized on a coil without a core, on a coil with a core, or with a coil having a mill spool which extends out beyond the plane of the coil sidewall or end. The adaptor prevents air from passing through the center of the coil.

In one embodiment, a cooling device having an air source is provided. A shroud of the device is positioned adjacent one lateral end of a coil, wherein air from the air source is directed through one or more apertures of an air directing surface of the shroud onto a surface of the coil, preferably near the inner diameter of the coil. The air flows in a gap between the surface of the coil and the air directing surface of the shroud toward the outer diameter of the coil, escaping along the end of the shroud or outer diameter of the coil. In another embodiment, the shroud air directing surface has an outer perimeter formed as an annulus, preferably having a diameter similar to the diameter of the coil. In a preferred embodiment, the adaptor of the shroud prevents air from flowing through the center of the coil.

It is, therefore, an object of the present invention to provide a cooling device that is mobile, portable, and can be easily positioned in relation to a coil in order to cool the coil for further handling or processing or a combination thereof.

A further object of the present invention is to provide a cooling device and method for utilizing the cooling device that improves heat transfer and cooling efficiency when compared to the prior art practice of providing forced air cooling by directing air from an axial flow fan at the lateral end of a coil.

Yet another object of the present invention is to provide a cooling device that is adapted to be utilized on a coil free of a core, on a coil with a core, or on a coil having a mill spool which extends out beyond the plane of an end of a coil.

Still another object of the present invention is to provide a shroud that can be easily retrofitted to an existing fan.

It is a further object of the present invention to provide a cooling device that utilizes air from an air source, increases the velocity of the air exiting the air source, and directs the air at a location near the inner diameter of a coil and subsequently along the surface of the coil.

Accordingly, one aspect of the present invention is a cooling device for use in cooling an article, comprising an air source that provides air flow, and a shroud that receives air flow from the air source and is adapted to direct the air onto a surface of the article, wherein the shroud includes a receiver that is connected to an air exhaust outlet of the air source, wherein the shroud includes an air directing surface having one or more apertures through which air flows out of the shroud, and wherein the one or more apertures have a total cross-sectional area that is less than a cross-sectional area of the air exhaust outlet.

Another aspect of the present invention is a cooling device for use in cooling a coil of material, comprising an air source that provides air flow through an air exhaust outlet, and a shroud connected to the air source that receives air from the air source exhaust outlet and is adapted to expel the air through one or more apertures of an air directing surface of the shroud, wherein the shroud includes an adaptor connected to the air directing surface of the shroud and adapted to substantially seal a core of the coil to prevent air flow through the core.

Still another aspect of the present invention is a method for cooling a coil, comprising the steps of providing a coil of material at a temperature above an ambient temperature, providing a cooling device comprising an air source that provides air flow and a shroud that receives air flow from the air source and is adapted to direct the air onto a surface of the coil, wherein the shroud includes a receiver that is connected to an air exhaust outlet of the air source, wherein the shroud includes an air directing surface having one or more apertures through which air flows out of the shroud, positioning the air directing surface of the cooling device adjacent an end of the coil, and directing air from the cooling device onto the coil end to cool the coil, wherein a velocity of the air exiting the one or more apertures is greater than a velocity of the air exiting the air exhaust outlet.

Yet another aspect of the invention is a cooling device for use in cooling an article, comprising an air source that provides air flow; and a shroud that receives air flow from the air source and is adapted to direct the air onto a surface of the article, wherein the shroud includes a receiver that is connected to an air exhaust outlet of the air source, wherein the shroud includes an air directing surface having one or more apertures through which air flows out of the shroud, wherein the air directing surface is substantially planar radially outward of an adaptor connected to the air directing surface and wherein the air directing surface is adapted to be positioned substantially parallel to a plane formed by an end of the article.

BRIEF DESCRIPTION OF THE DRAWINGS

The invention will be better understood and other features and advantages will become apparent by reading the Detailed Description of the Invention, taken together with the drawings, wherein.

DETAILED DESCRIPTION OF THE INVENTION

Figure 1:
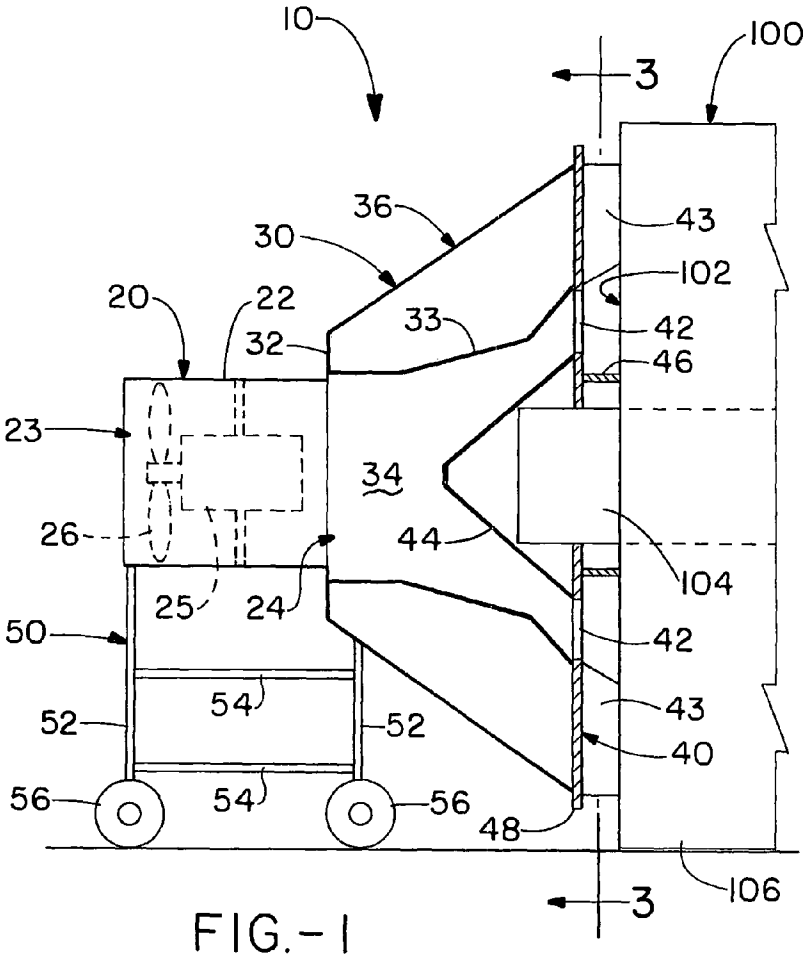
FIG. 1 is a side elevational view, in partial cross-section, of one embodiment of a cooling device of the present invention positioned adjacent to the lateral end of a coil.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or other axis, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to the drawings, the cooling device 10 of the present invention includes an air source 20 operatively connected to a base 50 in one embodiment as shown in FIG. 1. Air source 20 is utilized to generate or create air flow at a velocity for use by cooling device 10. Air source 20 is generally a fan having a housing 22, an air intake 23, and an air exhaust outlet 24. Air source 20 further includes a motor 25 operatively connected to housing 22. Motor 25 is preferably an electric motor operatively connected to an electrical switch. In one embodiment, motor 25 is operable at one or more different speeds.

An impeller or propeller 26 is operatively connected to an output shaft of motor 25. Propeller 26 includes one or more fan blades utilized to draw air into air intake 23 and expel the same through air exhaust outlet 24. The described air source 20 is known to those of ordinary skill in the art and is commercially available from sources such as Universal Fan and Blower of Bloomfield, Ontario, Canada and Continental Fan of Buffalo, N.Y., USA. There are generally no limitations regarding the horsepower of the fan, so long as the desired air flow is provided to cool a coil 100. A fan having a horsepower of less than 10 is utilized in this application in one embodiment to maintain ease of portability. In a preferred embodiment, an air source is utilized that is capable of maintaining relatively low flow rates at medium to high pressure without stalling or overloading, with an appropriate shroud design.

During use, a motor switch is actuated and motor 25 is energized, thereby producing rotation of propeller 26. The rotation of propeller 26 draws air inwardly through air intake 23 and discharges the air through exhaust outlet 24.

While the air source 20 described hereinabove is generally known in the art as an axial flow fan, any other air source such as a blower, a pump such as a rotary or centrifugal pump, a compressor, centifugal-blower or fan, tube-axial fan, or mixed flow fan, or the like can be utilized to provide a desired volume of air at a desired velocity to shroud 30 of cooling device 10.

Figure 2:
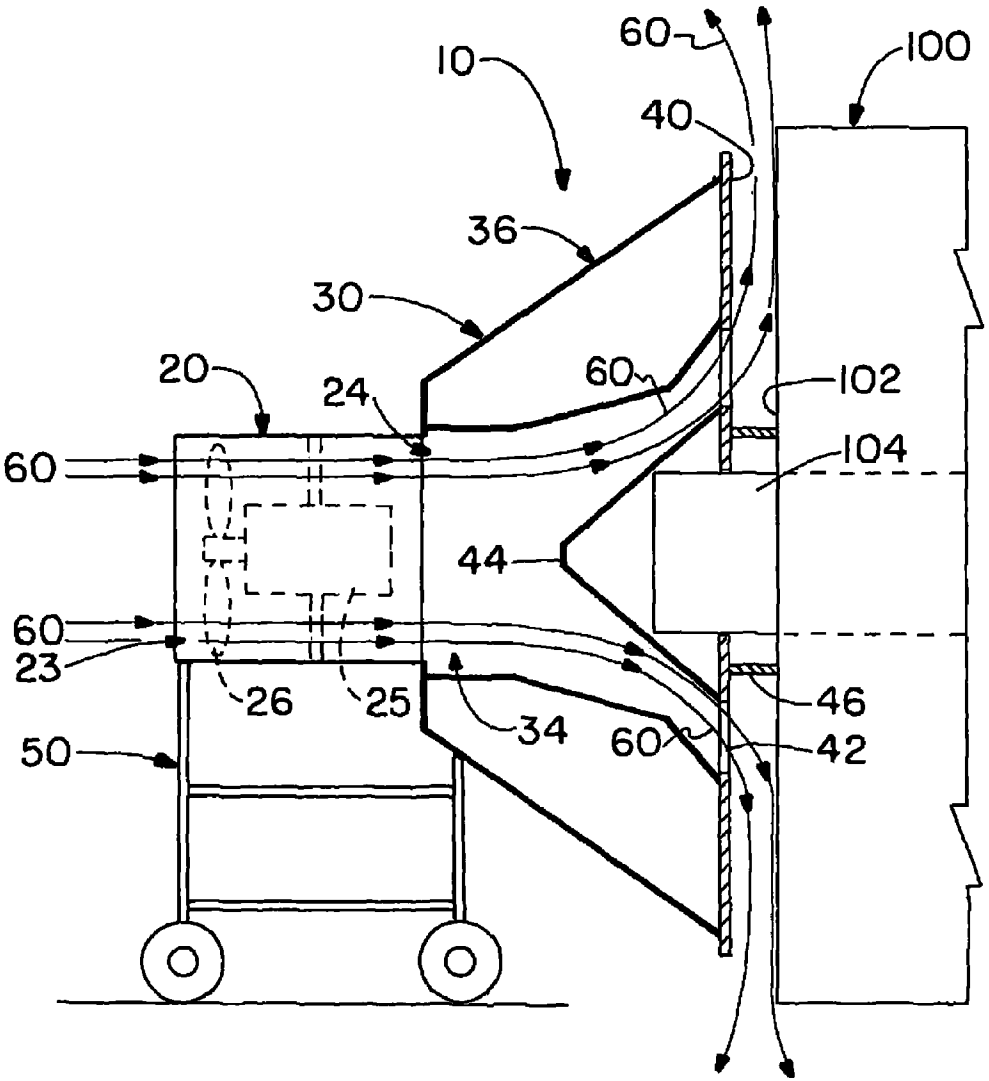
FIG. 2 is a partial side elevational schematic view of the cooling device of the present invention, particularly illustrating air flow through apertures of the device onto a surface of a coil.

Shroud 30 is connected to air source 20 and receives air expelled from exhaust outlet 24, as shown in FIG. 2. Receiver 32 of shroud 30 extends around a perimeter of air exhaust outlet 24 and channels air through one or more internal guide vanes 33 into interior 34 of shroud 30. The connection between receiver 32 of shroud 30 and air exhaust outlet 24 or housing 22 of air source 20 is airtight or substantially airtight in order to provide efficiency of airflow through cooling device 10. Any means known in the art can be utilized to connect shroud 30 to air source 20, such as a pressure fit, a latch, fasteners such as screws or nuts and bolts, adhesive, or the like, with a latch being preferred. In one embodiment, receiver 32 is an annular rim or flange conforming to the perimeter of air exhaust outlet 24 which typically has an annular opening.

Shroud 30 includes a body 36 that extends between receiver 32 to the shroud air directing surface 40 as shown in FIGS. 1 and 2. Shroud body 36 as illustrated is formed as a frustoconical structure. A first end of body 36, namely at receiver 32 forms a plane that is generally parallel to a plane at the second end of body 36 at air directing surface 40. Body 36 is not limited to the frustoconical shape shown, but can have any other desired configuration so long as receiver 32 is connected to air directing surface 40. Accordingly, body 36 can be cylindrical, rectangular, square, or the like, or combinations thereof. The function of body 36 is to transfer air received from air exhaust outlet 24 through apertures 42 of air directing surface 40.

Figure 3:
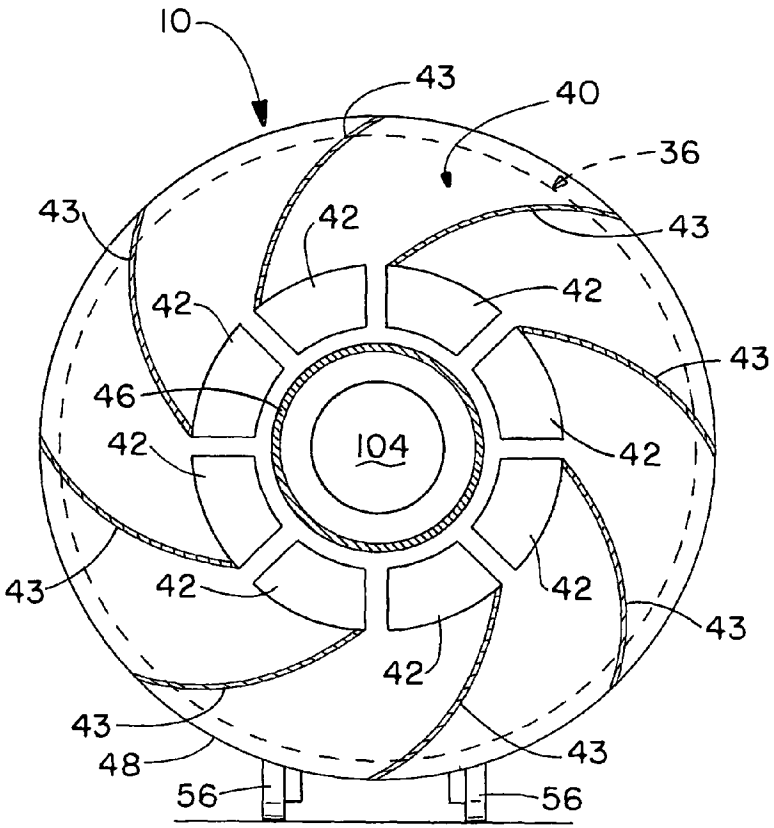
FIG. 3 is an elevational front view of one embodiment of a shroud of a cooling device of the present invention taken through line 3-3 of FIG. 1, particularly illustrating an air directing surface having apertures through which air can flow.

In a preferred embodiment, the direction of air flow 60 is changed from horizontal, i.e. the direction of air flow entering outlet 24 from air source 20, towards a direction substantially perpendicular or perpendicular thereto, such as shown in FIG. 2, in a gradual fashion to minimize the pressure drop and maximize the air velocity through the shroud 30. Air flow channeling and directing is particularly important in an application utilizing an axial fan which typically does not develop high pressure. Use of guide vanes 33 attached to the shroud 30 to help direct the air flow, such as shown in FIG. 2 is preferred in one embodiment. Cap or adaptor 44, as described hereinbelow, can also be contoured to aid in directing air flow. Known design principles of fluid dynamics can be applied to design the shape required for each application. In one embodiment, one or more air directing vanes such as spiral swirl vanes 43, as shown in FIG. 3, are incorporated on the coil side of the shroud 30 to increase the contact time and contact area of the cooling air with the coil 100.

In a preferred embodiment, several straight or curvilinear vanes 43, preferably of the same width as projection 46, are attached to the air directing surface 40 and extend from the edge of the air exit openings towards the outer diameter or perimeter 48 and cause the air to take a curving path across the coil face. Also, the distance maintained between the coil 100 and the shroud 30 is very important in the process for cooling a coil 100, and depends on the fan characteristics, i.e. pressure vs. flow, generally known as the fan characteristics curve. Accordingly, the distance between the coil 100 and shroud 30, such as at air directing surface 40, can be varied depending on the application.

In a further embodiment, shroud 30 is a substantially solid structure, but can include flexible elements in order to provide a desired air flow to a coil 100. Portions of the shroud 30 can be formed of generally any suitable material offering a desired rigidity or form, including, but not limited to, a polymer, a rubber, or an elastomer, either thermoplastic or thermoset, such as PVC; or any suitable metal. A requirement of shroud 30 is that the material chosen must be suitable in order to withstand and substantially not deform, degrade or the like, at the temperature of the coil 100 to be cooled, for a period of time.

As stated herein above, shroud 30 includes air directing surface 40 connected to body 36. Air directing surface 40 is adapted to be placed in close proximity to a coil 100 as illustrated in FIG. 1 in order to aid in heat transfer and cooling of the coil to a preferred temperature such as room temperature. Air directing surface 40 has a configuration adapted to direct air flow across a surface of the coil, preferably between coil lateral end surface 102 and the outer surface of air directing surface 40.

Air directing surface 40 includes one or more apertures 42. As illustrated in FIG. 3, a plurality of apertures 42 are shown arranged around an adaptor 44 in the radial interior portion of air directing surface 40. Any number of apertures can be utilized with, generally from 1 to about 16, desirably about 6 to about 10, and preferably about 8 apertures present. It is desirable in one embodiment of the present invention that the cross-sectional area of all of the apertures present on air directing surface 40 be less than the cross-sectional area of the air exhaust outlet 24 in order to provide an increase in air velocity through the apertures collectively when compared to air exhaust outlet 24 in order to provide improved heat transfer between the air and the coil, according to heat transfer theory.

In a preferred embodiment, a plurality of apertures 42 are spaced around the circumference of adaptor 44. In this alignment, the air flowing out of apertures 42 is directed onto the interior portion of lateral end surface 102 of coil 100 adjacent to spool 104 thereof. As illustrated in FIG. 2, air flow travels along lateral end surface 102 radially outwardly toward the outer diameter of coil 100. The size and number of apertures are matched to the fan characteristics curve and shroud design. In one embodiment, the total area of the apertures ranges generally from about 50% to about 90%, desirably about 60% to about 70%, and preferably about 66% of the area of the air exhaust outlet 24. The area of an imaginary annular cylinder extending between the coil end and the shroud at the outer diameter of the apertures is preferably 1 to 3 times less and most preferably 1.5 times less than the total area of the apertures. In a preferred embodiment, adaptor 44 includes projection 46 extending outwardly from air directing surface 40 and is adapted to be placed near and preferably abutted against coil 100. Preferably, projection 46 is substantially annular, or annular with a perimeter thereof extending completely around the coil core or mill spool 104. The diameter of the projection is dependent on the size of the core or mill spool 104. Accordingly, air is prevented from passing through the core of coil 100 or mill spool 104 about which coil 100 is wound. Projection 46 is further adapted to allow for a portion of a coil core such as a mill spool to be situated therein, should the mill spool 104 extend beyond the end of the coil 100.

Perimeter 48 of air directing surface 40 is preferably annular although it is to be understood that other shapes or designs can be utilized. Annular perimeter 48 is utilized as the same is complimentary to the shape of lateral end surface 102 of coil 100 which is also typically annular. In one embodiment, an annular perimeter 48 has a diameter that is about 5% less than the diameter of a coil 100, and at a minimum, is about 66% of the distance between the coil inner diameter and the coil outer diameter. The cooling device is situated adjacent the coil in one embodiment such that the area of the imaginary annular cylinder extending between the coil and the shroud at the outer diameter of the apertures 42 is preferably about 20% to about 60% of the area of exhaust outlet 24.

Base 50 or other suitable mount is utilized to support air source 20 and shroud 30. The structure of base 50 is not critical, so long as the air source 20 and shroud 30 are supported and allowed to perform their intended functions. In one embodiment as illustrated in FIG. 1, base 50 includes one or more legs interconnected by a frame 54. In a preferred embodiment, base 50 includes one or more wheels 56 that are operatively connected to frame 54, or leg 52 as shown in FIG. 1. Wheels 56 of base 50 allow cooling device 10 to be portable and easily moved to a desired position in relation to a coil or other object to be cooled. Wheels, if any, are provided with a lock to prevent the fan from moving away from the coil due to pressure in a preferred embodiment. Base 50 is constructed of any suitable materials or combinations of materials including, but not limited to, metal, polymer, wood, or the like.

Figure 4:
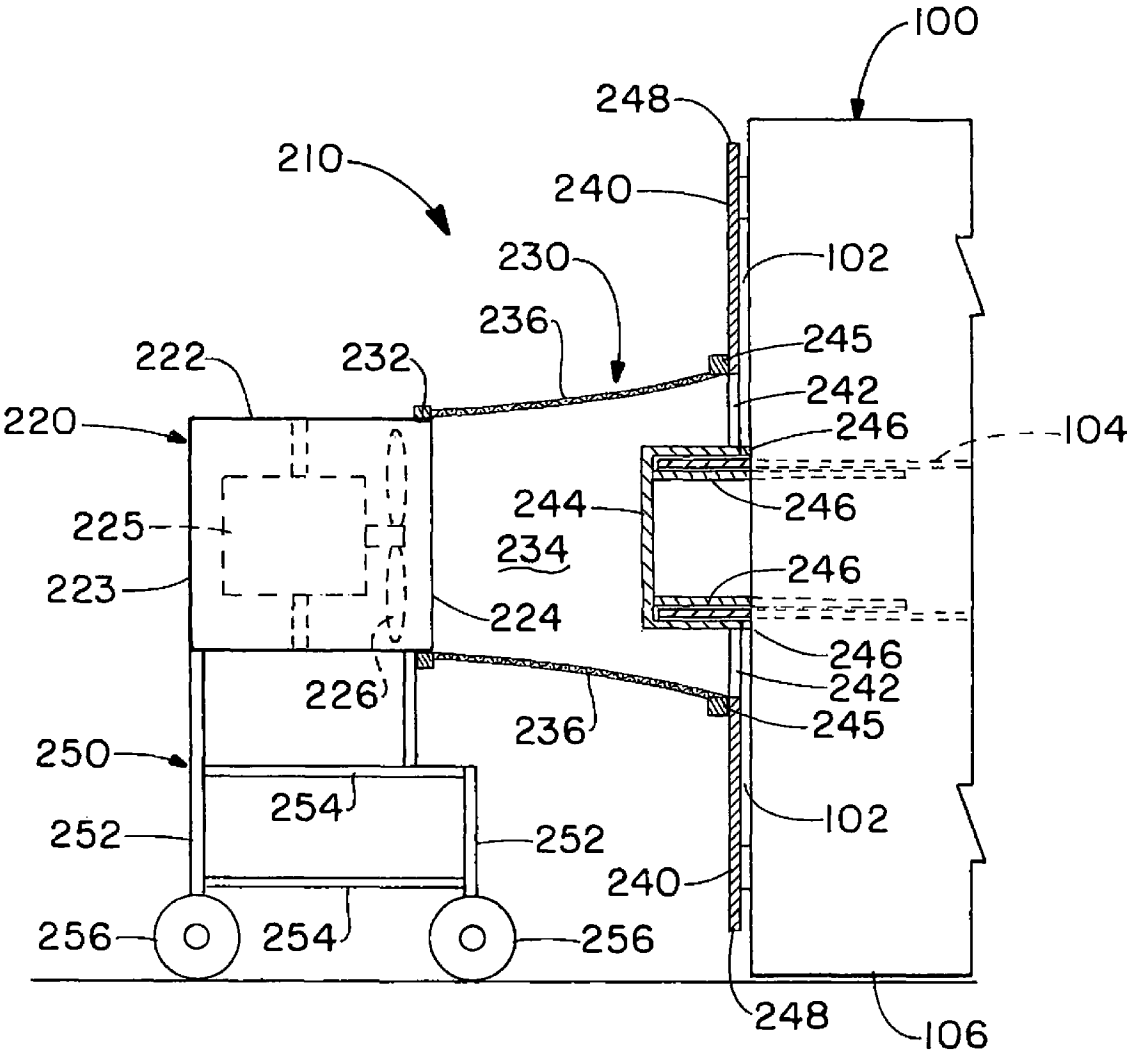
FIG. 4 is a side elevational view, in partial cross-section, of one embodiment of a cooling device of the present invention having a flexible shroud, positioned adjacent to the lateral end of a coil.

In one embodiment such as shown in FIG. 4, a cooling device 210 is provided having a shroud 230 having at least a portion thereof that is flexible. When shroud body 236 or other portion of shroud 230 is flexible, on either all or a part thereof, various materials can be utilized, including, but not limited to, plastic or fabric such as fabric including ducting with a support such as a spiral-wound spring-wire, or the like.

Flexible shroud 230 includes a receiver 232 that is connected to air exhaust outlet 224 of axial fan 220 to receive air therefrom and direct air into interior 234 of shroud 230. As described above, axial fan 220 includes an air inlet 223, motor 225 and propeller 226. The end of flexible shroud 230 generally opposite axial fan 220 is detachably connected to an air directing surface 240 via a locking mechanism 245 that permits quick disassembly for ease of handling. Air directing surface includes an adaptor 244 and one or more projections 246 of adaptor 244 that can be operatively attached to a spool plug component that optionally extends outwardly from the coil. The adaptor 244 can be moved towards or away from the coil to make a desired seal with the spool 104. As also described hereinabove, air directing surface 240 includes one or more apertures 242 that direct air into the coil 100. Air directing surface 240 can include one or more air directing vanes as described hereinabove.

Adaptor 244 in one embodiment as shown in FIG. 4 has an elongated, preferably annular, projection 246 that extends into mill spool 104, that is also typically annular. The elongated projection 246 has a length sufficient to support air directing surface 240 on coil 100. In a preferred embodiment, the elongated projection 246 has an outer diameter slightly less than the inner diameter of mill spool 104 for a snug or friction fit.

Adaptor 244 provides support for air directing surface 240 and can rest on mill spool 104 or otherwise be operatively connected thereto.

The flexible shroud 230 advantageously allows the cooling device 210 to be utilized on coils having different core heights above a ground surface. For example, in one embodiment, air directing surface 240 is operatively connected to a core of a coil to be cooled such as shown in FIG. 4, with the core situated at a particular height above the ground surface due to the radius of the coil as well as the height of any object the coil is situated on, if any. Depending on the height of the air directing surface 240 operatively connected to the coil, the end of flexible shroud 230 opposite receiver 230 is moved upward or downward and subsequently connected to air directing surface 240 using locking mechanism 245. Accordingly, depending on the height of the core above a ground surface, the outer surface of flexible shroud body 236 between receiver 232 and air directing surface 240 can have a curved appearance.

Cooling device 210 includes a base 250 that supports air source 220. In one embodiment, base 250 includes one or more wheels 256 operatively connected to frame 254 or leg 252 such as shown in FIG. 4. As described hereinabove, wheels 256 can be provided with a lock to prevent the fan 220 from moving away from the coil 100.

In order to utilize cooling device 10 of the present invention, cooling device 10 is moved into a desired position in relation to a coil 100, such as illustrated in FIGS. 1 and 2. Preferably, projection 46 is aligned over or around spool 104 of coil 100 forming a seal to prevent air flow therethrough. Air source 20 is actuated and air flows through air exhaust outlet 24 into interior 34 of body 36 of shroud 30. Air flows out of interior 34 through one or more apertures 42 toward lateral end surface 102 of coil 100. Since the air flow cannot deeply penetrate lateral end surface 102, the forced air continues to flow radially outward toward the outer diameter of coil 100 between air directing surface 40 and lateral end surface 102. The air flow is generally perpendicular to the horizontal axis of the coil. Shroud 30 increases air velocity from the air source, thereby increasing the heat transfer. In an alternative embodiment, the power required for the air source 20 may be reduced for equivalent cooling capacity since utilization of the cooling air is more efficient. Shroud 30 and base 50 can be easily retrofitted to existing air source 20.

Articles that can be cooled by the present invention include any material, such as a coil or a non-coil article, preferably a metal or metal alloy. Non-coil metal articles include examples such as a sheet, plate, or ingot. Sheet material utilized to form coil 100 can have any thickness. However, in general air cooling of the type desired herein is most efficient with thinner material due to the larger number of windings per coil. Air gaps and surface roughness between laps tend to provide an insulating effect. The more of these discontinuities there are, the more heat movement and thus cooling is favored in the axial direction. In a preferred embodiment, coil 100 is aluminum or an aluminum alloy. Generally any of the numerous one or more 1xxx through 9xxx series alloy articles such as, but not limited to, sheets, plates, coils, and ingots according to the Aluminum Association Designation for Wrought Aluminum Alloys can be utilized. Coil 100 preferably has a side surface 106 having a perimeter that is circular, although side surfaces of other configurations which are not circular, but are substantially circular, oval, or the like can also be utilized. As described herein, coil 100 can have a center or core comprising a spool 104 that is hollow or solid. Coil 100 can be wound upon a mill spool 104 which can be of any suitable composition such as steel, aluminum or fiber. While coil 100 can generally have any diameter, typical diameters range from about 76.2 cm (30 inches) to about 25.40 cm (100 inches), and spools typically vary between about 20.3 cm (8 inches) to about 122 cm (48 inches), but can be smaller or larger.

In accordance with the patent statutes, the best mode and preferred embodiment have been set forth, the scope of the invention is not limited thereto, but rather by the scope of the attached claims.

What is claimed is:

1. A cooling device for use in cooling an article, comprising:

an air source that provides air flow; and a shroud that receives air flow from the air source and is adapted to direct the air onto a surface of the article, wherein the shroud includes an end having a receiver that is connected to an air exhaust outlet of the air source, wherein the shroud includes an air directing surface connected to an end of the shroud opposite the receiver end, the air directing surface having a outer surface outside of the shroud and having a plurality of apertures through which air flows out of the shroud, wherein the one or more apertures have a total cross-sectional area that is less than a cross-sectional area of the air exhaust outlet, wherein the article is a coil of sheet metal, wherein the shroud includes an annular adaptor connected to the outer surface of the air directing surface and adapted to abut an end of the coil and form a seal around a core of the coil to prevent air flow through the core, wherein the plurality of apertures are located on the air directing surface outer surface spaced around the circumference of the adaptor, and wherein the air directing surface is adapted to direct air flow across a surface of the coil between the coil end and the outer surface of the air directing surface.

2. The cooling device according to claim 1, wherein the total cross-sectional area of the plurality of apertures is from about 50% to about 90% of the cross-sectional area of the air exhaust outlet.

3. The cooling device according to claim 2, wherein the total cross-sectional area of the plurality of apertures is from about 60% to about 70% of the cross-sectional area of the air exhaust outlet.

4. The cooling device according to claim 2, wherein the adaptor includes one or more substantially annular members extending outwardly from the air directing surface outer surface and having an end adapted to abut the coil end or be situated in the core of the coil, or a combination thereof.

5. The cooling device according to claim 4, wherein an outer perimeter of the air directing surface outer surface is substantially annular, and wherein one or more air directing vanes extend outwardly from the air directing surface outer surface to direct air flowing out from the plurality of apertures along the end of the coil.

6. The cooling device according to claim 4, wherein 2 to about 16 apertures are present, and wherein the shroud includes an internal guide vane that directs air flow toward the one or more apertures.

7. The cooling device according to claim 6, wherein the internal guide vane extends between the receiver and the air directing surface.

8. The cooling device according to claim 2, wherein the air directing surface outer surface is substantially planar radially outward of the adaptor and adapted to be positioned substantially parallel to a plane formed by an end of the coil.

9. The cooling device according to claim 1, wherein the air source is a fan, a blower, a pump, or a compressor.

10. The cooling device according to claim 9, wherein the air source is an axial flow fan.

11. The cooling device according to claim 10, wherein at least a portion of a body of the shroud is flexible.

12. The cooling device according to claim 1, wherein the article is a coil of wound aluminum sheet metal comprising a core.

13. A cooling device for use in cooling a coil of sheet material, comprising:

an air source that provides air flow through an air exhaust outlet; and a shroud connected to the air source that receives air from the air source exhaust outlet and is adapted to expel the air outside of the shroud through more a plurality of apertures of an air directing surface of the shroud, wherein the shroud includes an adaptor connected to an outer surface of the air directing surface located on the outer surface of the shroud and the adaptor adapted to substantially seal a core of the coil to prevent air flow through the core, wherein the adaptor includes one or more substantially annular members extending outwardly from the outer surface of the air directing surface having an end adapted to abut the coil end or be situated in the core of the coil, or a combination thereof, wherein the plurality of apertures are located on the outer surface of the air directing surface and are spaced around the circumference of the adaptor, and wherein the air directing surface is adapted to direct air flow across a surface of the coil between a coil end and the outer surface of the air directing surface.

14. The cooling device according to claim 13, wherein the plurality of apertures have a total cross-sectional area that is less than a cross-sectional area of the air exhaust outlet.

15. The cooling device according to claim 14, wherein the total cross-sectional area of the plurality of apertures is from about 50% to about 90% of the cross-sectional area of the air exhaust outlet.

16. The cooling device according to claim 15, wherein one or more air directing vanes extend outwardly from the air directing surface outer surface to direct air flowing out from the plurality of apertures along the end of the coil.

17. The cooling device according to claim 14, wherein an outer perimeter of the air directing surface outer surface is substantially annular.

18. The cooling device according to claim 17, wherein the shroud has a body that connects the receiver and the air directing surface, wherein the body is frustoconical shaped.

19. The cooling device according to claim 15, wherein the air directing surface outer surface is substantially planar and adapted to be positioned substantially parallel to a plane formed by the end of the coil, and wherein at least a portion of the body of the shroud is flexible.

20. The cooling device according to claim 15, wherein the air source is a fan, a blower, a pump, or a compressor.

21. The cooling device according to claim 15, wherein the shroud includes an internal guide vane that directs air flow toward the plurality of apertures, and wherein the internal guide vane extends between the receiver and the air directing surface.

22. The cooling device according to claim 13, wherein the sheet material is a coil of wound aluminum sheet metal comprising a core.

23. A cooling device for use in cooling an article, comprising:

an air source that provides air flow; and a shroud that receives air flow from the air source and is adapted to direct the air onto a surface of the article, wherein the article is a coil of sheet metal, wherein the shroud includes a receiver that is connected to an air exhaust outlet of the air source, wherein the shroud includes an air directing surface having one or more apertures through which air flows out of the shroud, wherein an outer surface of the air directing surface located on an outer surface of the shroud is substantially planar radially outward of an adaptor connected to the outer surface of the air directing surface and wherein the air directing surface outer surface is adapted to be positioned substantially parallel to a plane formed by an end of the coil, wherein the one or more apertures are located around the outside of a perimeter of the adaptor, wherein one or more air directing vanes extend outwardly from the air directing surface outer surface to direct air flowing out of the shroud from the one or more apertures along the end of the coil, and wherein the air directing surface is adapted to direct air flow across a surface of the coil between the coil end and the outer surface of the air directing surface.

24. The cooling device according to claim 23, wherein the one or more apertures have a total cross-sectional area that is less than a cross-sectional area of the air exhaust outlet.

25. The cooling device according to claim 24, wherein the total cross-sectional area of the one or more apertures is from about 50% to about 90% of the cross-sectional area of the air exhaust outlet.

26. The cooling device according to claim 25, wherein the total cross-sectional area of the one or more apertures is from about 60% to about 70% of the cross-sectional area of the air exhaust outlet, wherein the article is a metal article.

27. The cooling device according to claim 24, wherein the adaptor is adapted to abut the end of the coil and form a seal around a core of the coil to prevent air flow through the core.

28. The cooling device according to claim 27, wherein the adaptor includes one or more substantially annular members extending outwardly from the air directing surface outer surface and having an end adapted to abut the coil end or be situated in the core of the coil, or a combination thereof.

29. The cooling device according to claim 28, wherein an outer perimeter of the air directing surface outer surface is substantially annular.

30. The cooling device according to claim 29, wherein 2 to about 16 apertures are present, and wherein the shroud includes an internal guide vane that directs air flow toward the one or more apertures.

31. The cooling device according to claim 30, wherein the internal guide vane extends between the receiver and the air directing surface.

32. The cooling device according to claim 23, wherein the air source is a fan, a blower, a pump, or a compressor.

33. The cooling device according to claim 23, wherein at least a portion of a body of the shroud is flexible.

34. The cooling device according to claim 23, wherein the article is a coil of wound aluminum sheet metal comprising a core.

* * * * *

UNITED STATES PATENT AND TRADEMARK OFFICE

CERTIFICATE OF CORRECTION

PATENT NO. : 7,947,218 B2
APPLICATION NO. : 11/807456
DATED : May 24, 2011
INVENTOR(S) : Stephen D. Simpson et al.

It is certified that error appears in the above-identified patent and that said Letters Patent is hereby corrected as shown below:

Claim 13, column 9, line 48, please delete “more”.

Signed and Sealed this
Second Day of August, 2011

David J. Kappos

David J. Kappos
*Director of the United States Patent and Trademark Office*